US010977986B2

(12) United States Patent
Xiang et al.

(10) Patent No.: US 10,977,986 B2
(45) Date of Patent: Apr. 13, 2021

(54) PRESET REVERSE DRIVE METHOD APPLIED IN VIDEO DISPLAYING PROCESS

(71) Applicant: TCL TECHNOLOGY GROUP CORPORATION, Huizhou (CN)

(72) Inventors: Chaoyu Xiang, Huizhou (CN); Le Li, Huizhou (CN); Lei Qian, Huizhou (CN); Yixing Yang, Huizhou (CN); Weiran Cao, Huizhou (CN)

(73) Assignee: TCL TECHNOLOGY GROUP CORPORATION, Huizhou (CN)

( * ) Notice: Subject to any disclaimer, the term of this patent is extended or adjusted under 35 U.S.C. 154(b) by 0 days.

(21) Appl. No.: 16/605,186

(22) PCT Filed: Apr. 13, 2018

(86) PCT No.: PCT/CN2018/082897
§ 371 (c)(1),
(2) Date: Oct. 14, 2019

(87) PCT Pub. No.: WO2018/214667
PCT Pub. Date: Nov. 29, 2018

(65) Prior Publication Data

US 2020/0312227 A1 Oct. 1, 2020

(30) Foreign Application Priority Data

May 23, 2017 (CN) ..... 201710369581.X

(51) Int. Cl.
*G09G 3/32* (2016.01)

(52) U.S. Cl.
CPC ..... *G09G 3/32* (2013.01); *G09G 2320/043* (2013.01)

(58) Field of Classification Search
CPC ..... G09G 3/32
(Continued)

(56) References Cited

U.S. PATENT DOCUMENTS 6,201,520 B1 3/2001 Iketsu et al.
2002/0140691 A1* 10/2002 Sato ..... G02F 1/134363 345/212

(Continued)

FOREIGN PATENT DOCUMENTS

CN 1588515 A 3/2005
CN 1828707 A 9/2006

(Continued)

OTHER PUBLICATIONS

The World Intellectual Property Organization (WIPO) International Search Report for PCT/CN2018/082897 dated Jun. 22, 2018 5 Pages.

*Primary Examiner* — Long D Pham
(74) *Attorney, Agent, or Firm* — Anova Law Group, PLLC

(57) ABSTRACT

Disclosed in the present disclosure is a preconfigured reverse drive method applied in a video displaying process. The method comprises the steps of: pre-obtaining display content of several frames behind lit pixels in a video by means of content loading; and adding a reverse drive signal before each forward drive signal used for driving the display content of the several frames, to suppress electric charge concentration on pixel in a video display panel in advance. The reverse drive signal changes the potential barrier of the detect potential well, removes electric charges confined and concentrated in the potential well, and reduces the density of confined electric charges. Thus, the video display brightness is improved, and the service life of the video display panel is prolonged.

19 Claims, 23 Drawing Sheets

(58) Field of Classification Search
USPC ..... 345/208
See application file for complete search history.

(56) References Cited

U.S. PATENT DOCUMENTS

| | | | | |
|---|---|---|---|---|
| 2003/0043090 | A1 | 3/2003 | Yazawa et al. | |
| 2005/0078078 | A1* | 4/2005 | Morita | G09G 3/3688 345/100 |
| 2006/0022900 | A1 | 2/2006 | Miyake et al. | |
| 2006/0197462 | A1 | 9/2006 | Uchiyama et al. | |
| 2007/0024537 | A1 | 2/2007 | Choong et al. | |
| 2007/0146394 | A1* | 6/2007 | Ahn | G09G 3/3208 345/690 |
| 2007/0262920 | A1 | 11/2007 | Werner et al. | |
| 2008/0309234 | A1 | 12/2008 | Cho et al. | |
| 2009/0219231 | A1 | 9/2009 | Yamamoto et al. | |
| 2010/0283045 | A1 | 11/2010 | Uchida | |
| 2013/0069552 | A1 | 3/2013 | Aurongzeb et al. | |
| 2014/0138664 | A1 | 5/2014 | Matsuura et al. | |
| 2016/0042719 | A1 | 2/2016 | Muramatsu | |
| 2017/0061839 | A1 | 3/2017 | Park et al. | |

FOREIGN PATENT DOCUMENTS

| | | | |
|---|---|---|---|
| CN | 1886015 | A | 12/2006 |
| CN | 1991947 | A | 7/2007 |
| CN | 101266748 | A | 9/2008 |
| CN | 101276564 | A | 10/2008 |
| CN | 101990347 | A | 3/2011 |
| CN | 1991947 | B | 4/2011 |
| CN | 102136243 | A | 7/2011 |
| CN | 103456277 | A | 12/2013 |
| CN | 104362258 | A | 2/2015 |
| CN | 105047138 | A | 11/2015 |
| CN | 105792430 | A | 7/2016 |
| CN | 106098956 | A | 11/2016 |
| CN | 106549111 | A | 3/2017 |
| JP | 2006119179 | A | 5/2006 |
| JP | 2006215255 | A | 8/2006 |
| JP | 2007079545 | A | 3/2007 |
| JP | 2009204887 | A | 9/2009 |
| KR | 100841850 | B1 | 6/2008 |
| WO | 2017052727 | A1 | 3/2017 |

* cited by examiner

PRESET REVERSE DRIVE METHOD APPLIED IN VIDEO DISPLAYING PROCESS

This application is a National Stage entry under § 371 of International Application No. PCT/CN2018/082897, filed on Apr. 13, 2018, and claims priority to Chinese Patent Application No. 201710369581.x, filed on May 23, 2017, the entire contents of which are hereby incorporated as reference.

TECHNICAL FIELD

The present disclosure relates to the field of display panels, and in particular relates to a preset reverse driving method applied in a video display process.

BACKGROUND TECHNOLOGY

The lifetime of quantum dot light-emitting diodes (QLEDs) has always been a bottleneck restricting its wide application. In addition to optimizing materials, devices, and fabrication processes, driving quantum dot light-emitting diodes may also be an approach to decrease the attenuation of the QLEDs and enhance the lifetime of the QLEDs.

A quantum dot light-emitting diode is generally composed of a first electrode, a hole transport layer, a quantum dot light-emitting layer, an electron transport layer, and a second electrode. Since different layers have different energy levels (that is, there exists an energy level difference), during operation, electric charges accumulate at the interface between two energy levels, especially the interface in contact with the quantum dot light-emitting layer. This can greatly affect the luminescent properties of the quantum dots, thereby reducing the luminous intensity; and these defects also limit the carriers. As the operating time of a quantum dot light-emitting diode increases, more and more electric charges are confined to the interface, which serves as the center of quenching photons, thereby greatly reducing the luminous intensity and shortening the lifetime of quantum dot light-emitting diodes.

Also, in a video display process, when the LED in the display panel is a quantum dot light-emitting diode, the accumulation of charges may seriously affect the brightness of the video display and the lifetime of the video display panel when driving the video content display.

Therefore, the above technology has yet to be improved and developed.

SUMMARY OF THE INVENTION

In view of the above deficiencies of the prior art, an objective of the present disclosure is to provide a preconfigured reverse driving method applied in a video display process, which aims to solve the problem that the video display brightness and the lifetime of the video display panel is seriously affected by long-time accumulation of electric charges in existing video displaying processes.

The technical solutions of the present disclosure are as follows:

A preconfigured reverse driving method applied in a video displaying process, comprising the steps of:

Step A: Pre-acquiring display content of a plurality of later frames for pixels in the video by content loading;

Step B: Adding a reverse driving signal before each forward driving signal for driving the display content of the plurality of frames, to suppress accumulation of electric charges on the pixels in the video display panel in advance.

In the preconfigured reverse driving method applied in a video displaying process, the intensity of the reverse driving signal is proportional to the intensity of the forward driving signal.

In the preconfigured reverse driving method applied in a video displaying process, the reverse driving signal is one of: a reverse voltage, a reverse current, or an alternation of the reverse voltage and the reverse current.

In the preconfigured reverse driving method applied in a video displaying process, the reverse voltage is lower than a breakdown voltage of a video display panel.

In the preconfigured reverse driving method applied in a video displaying process, the reverse current is lower than a breakdown current of a video display panel.

In the preconfigured reverse driving method applied in a video displaying process, the waveform of the reverse driving signal is at least one of: a square wave, a triangular wave, a ramp wave or a sine wave.

In the preconfigured reverse driving method applied in a video displaying process, when the reverse driving signal is an alternation of the reverse voltage and the reverse current, a percentage of a sum of a time for the reverse voltage and a time for the reverse current in a cycle is 1% to 99%.

In the preconfigured reverse driving method applied in a video displaying process, the reverse driving signal and the forward driving signal constitute a driving cycle, when the reverse driving signal is an alternation of the reverse voltage and the reverse current, a percentage of a sum of a time for the reverse voltage and a time for the reverse current in a cycle is 10% to 60%.

In the preconfigured reverse driving method applied in a video displaying process, the reverse driving signal and the forward driving signal constitute a driving cycle, when the reverse driving signal is a reverse voltage, a percentage of a time for the reverse voltage in a cycle is 1% to 99%; or a frequency of the reverse voltage is not less than 60 Hz; or an amplitude of the reverse voltage is −0.1V to −10V.

In the preconfigured reverse driving method applied in a video displaying process, the reverse driving signal and the forward driving signal constitute a driving cycle, when the reverse driving signal is a reverse voltage, a percentage of a time for the reverse voltage in a cycle is 10% to 60%; or t frequency of the reverse voltage is 60-240 Hz; or the magnitude of the reverse voltage is −1V to −5V.

In the preconfigured reverse driving method applied in a video displaying process, the reverse driving signal and the forward driving signal constitute a driving cycle. When the reverse driving signal is a reverse current, a percentage of a time for the current in a cycle is 1% to 99%; the frequency of the reverse current is not less than 60 Hz; or the magnitude of the reverse current is $-0.0001\ Am/cm^{-2}$ to $-1\ Am/cm^{-2}$.

In the preconfigured reverse driving method applied in a video displaying process, the reverse driving signal and the forward driving signal constitute a driving cycle. When the reverse driving signal is a reverse current, a percentage of a time for the reverse current in a cycle is 10% to 60%; or the frequency of the reverse current is 60-240 Hz; or the magnitude of the reverse current is $-0.0001\ Am/cm^{-2}$ to $-0.1\ Am/cm^{-2}$.

In the method applied in a preconfigured reverse driving method in a video displaying process, a vacant driving signal is in the middle of the reverse driving signal.

In the preconfigured reverse driving method applied in the video displaying process, the reverse driving signal, the forward driving signal and the vacant driving signal constitute a driving cycle, and the percentage of the time for the vacant driving signal in a cycle is 0%-15%.

In the preconfigured reverse driving method applied in a video displaying process, the reverse driving signal, the forward driving signal, and the vacant driving signal constitute a driving cycle. When the reverse driving signal is an alternation of the reverse voltage and the reverse current, the percentage of a sum of a time for the reverse voltage and a time for the reverse current in a cycle is 1% to 99%.

In the preconfigured reverse driving method applied in a video displaying process, wherein the reverse driving signal, the forward driving signal, and the vacant driving signal constitute a driving cycle. When the reverse driving signal is an alternation of the reverse voltage and the reverse current, the sum of a time for the reverse voltage and the percentage of a time for the reverse current in a cycle is 10% to 60%.

In the preconfigured reverse driving method applied in a video displaying process, the reverse driving signal, the forward driving signal, and the vacant driving signal constitute a driving cycle. When the reverse driving signal is a reverse voltage, the percentage of the time for the reverse voltage in a cycle is 1% to 99%; or the frequency of the reverse voltage is not less than 60 Hz; or the magnitude of the reverse voltage is −0.1V to −10V.

In the preconfigured reverse driving method applied in a video displaying process, the reverse driving signal, the forward driving signal, and the vacant driving signal constitute a driving cycle. When the reverse driving signal is a reverse voltage, the percentage of the time for the reverse voltage in a cycle is 10%-60%; or the frequency of the reverse voltage is between 60 Hz and 240 Hz; or the amplitude of the reverse voltage is −1V to −5V.

In the preconfigured reverse driving method applied in a video displaying process, the reverse driving signal, the forward driving signal, and the vacant driving signal constitute a driving cycle, when the reverse driving signal is a reverse current, a percentage of the time for the reverse current in a cycle is 1%-99%; or a frequency of the reverse current is not less than 60 Hz; or the amplitude of the reverse current is −0.0001 $Am/cm^{-2}$ to −1 $Am/cm^{-2}$.

In the preconfigured reverse driving method applied in a video displaying process, the reverse driving signal, the forward driving signal, and the vacant driving signal constitute a driving cycle, when the reverse driving signal is a reverse current, the percentage of the time for the reverse current in a cycle is 10%-60% of the cycle; or a frequency of the reverse current is 60 to 240 Hz; or an amplitude of the reverse current is −0.0001 $Am/cm^{-2}$ to −0.1 $Am/cm^{-2}$.

Advantageous Effects

The present disclosure provides a preconfigured reverse driving method applied in a video displaying process: pre-acquiring display content of a plurality of later frames for pixels in a video by content loading; adding a reverse driving signal before each forward driving signal for driving the display content of the plurality of frames, to suppress accumulation of electric charges on pixels in a video display panel in advance. The reverse driving signal changes the barrier of the defect potential well, eliminates confinement and accumulation of the electric charges in the potential well, reduces the density of the electric charges, which increases the brightness of the video display and extends the lifetime of the video display panel.

DETAILED DESCRIPTION OF THE EMBODIMENTS

The present disclosure provides a preconfigured reverse driving method applied in a video display process. In order to make the objects, technical solutions and effects of the present disclosure clear, the present disclosure will be further described in detail below. It is understood that the specific embodiments described herein are merely illustrative of the present disclosure and are not intended to limit the present disclosure.

Figure 1:
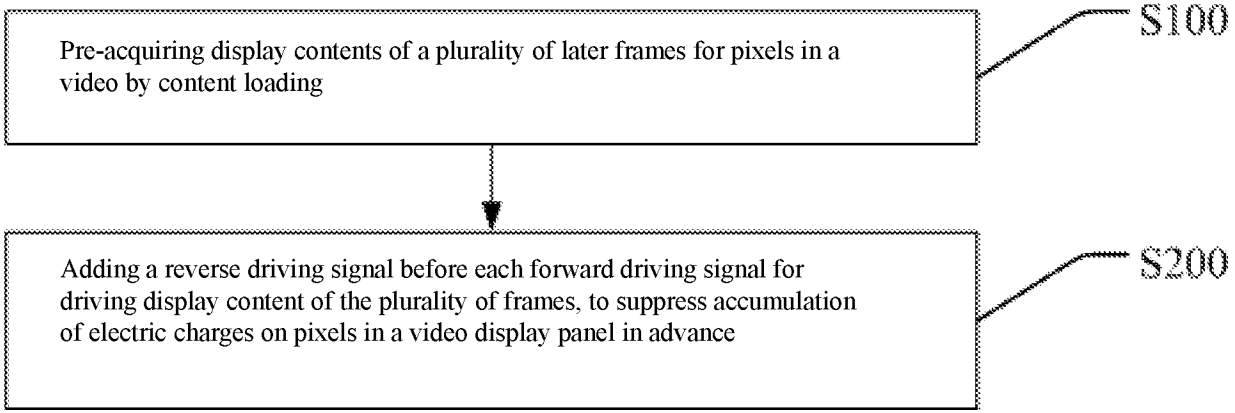
FIG. 1 is a flow chart of an embodiment of a preconfigured reverse driving method applied in a video displaying process of the present disclosure.

The present disclosure provides a preconfigured reverse driving method applied in a video displaying process, wherein, as shown in FIG. 1, includes the steps:

S100: Pre-acquiring display content of a plurality of later frames for video pixels by content loading;

S200: Adding a reverse driving signal before each forward driving signal for driving the display content of the plurality of frames, to suppress accumulation of electric charges on pixels in a video display panel in advance.

Figure 2:
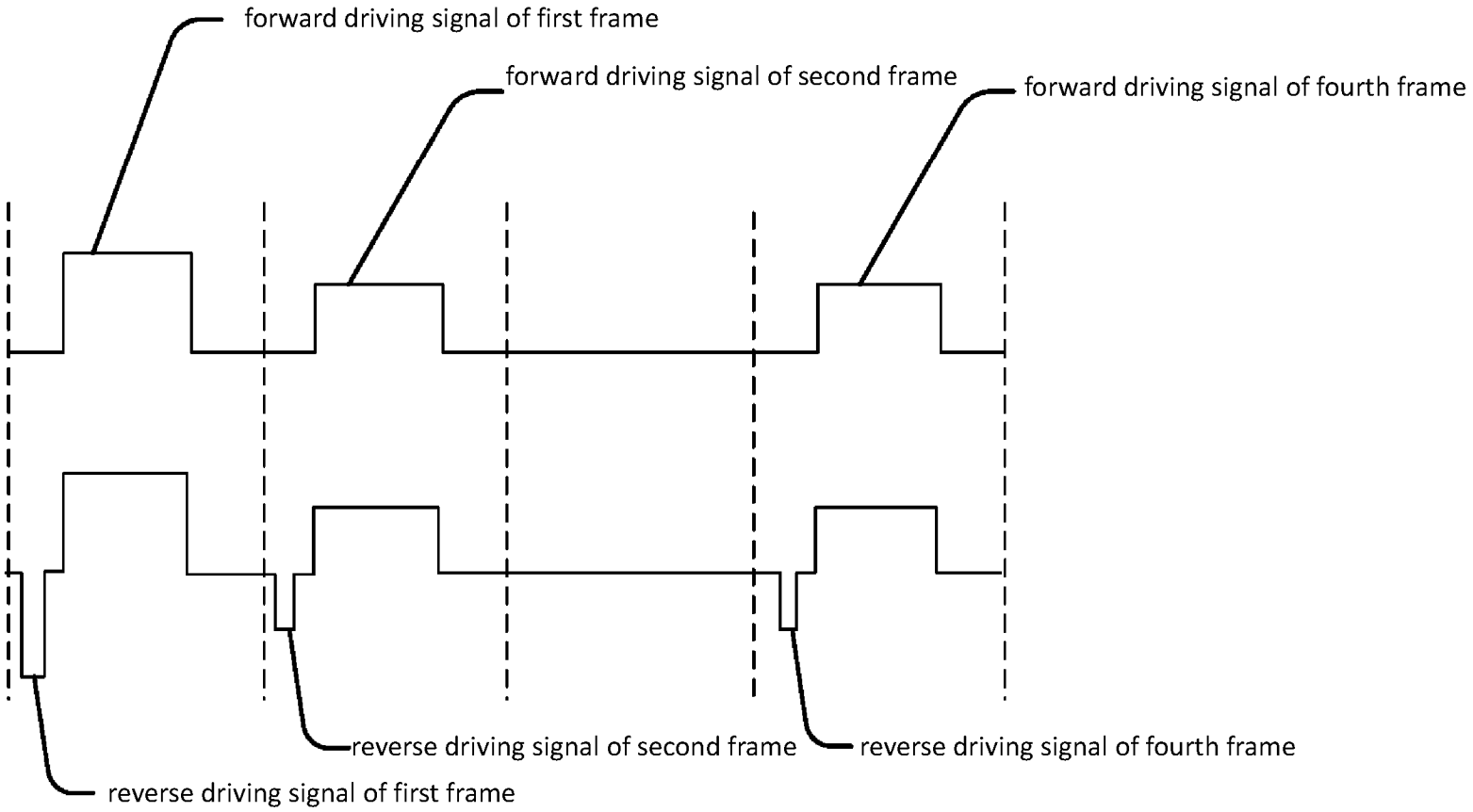
FIG. 2 is a first comparative diagram of with versus without a reverse driving signal being applied according to the present disclosure.

Specifically, in a display mode of a fixed content such as a movie video, the display panel may pre-acquire the display content of the plurality of later frames for pixels by content loading; that is, the display panel can acquire the display content of a plurality of frames after the current image when playing the current image. In the present disclosure, an example illustrates acquiring the display content of the four later frames for pixels, as shown in FIG. 2, in the acquired four-frame display content, there is no preconfigured reverse driving signal in the forward driving signal in the upper portion of FIG. 2 while there is preconfigured reverse driving signal before the forward driving signal in the lower portion of FIG. 2. In the present disclosure, the accumulation of electric charges during video displaying can be suppressed in advance, by adding a reverse driving signal before the forward driving signal, to improve the lifetime of the video display panel and the brightness of the video display.

Further, the reverse driving signal is also applied when a pixel is not yet illuminated, because in the video displaying process, the content of several frames after the current image can be acquired in advance by content loading; that is, during the video displaying process of the display panel, information on which pixels will be illuminated and which pixels will not be illuminated in subsequent images can be pre-acquired. Based on the above, in the present disclosure, adding a reverse driving signal in advance to unilluminated pixels in the subsequent images, can suppress the accumulation of electric charges of pixels in the video display panel in advance accordingly.

Further, as shown in FIG. 2, an intensity of the reverse driving signal is proportional to an intensity of the forward driving signal. For example, the intensity of the forward driving signal may be divided into levels 0-225, and the reverse driving signal is proportional to levels 0-225; the reverse driving signal is lower than a breakdown signal of the video display panel. That is, more electric charges are accumulated in the potential well when the forward driving signal is strong, and hence, a strong reverse driving signal is needed to suppress and eliminate the accumulated electric charges to improve the lifetime of the video display panel accordingly. As shown in FIG. 2, the forward driving signal of the first frame image is stronger than the forward driving signal of the second frame image or the forward driving signal of the fourth frame image, and therefore, the reverse driving signal of the first frame image is correspondingly stronger than the reverse driving signal of the second frame image or the reverse driving signal of the fourth frame image.

Figure 3:
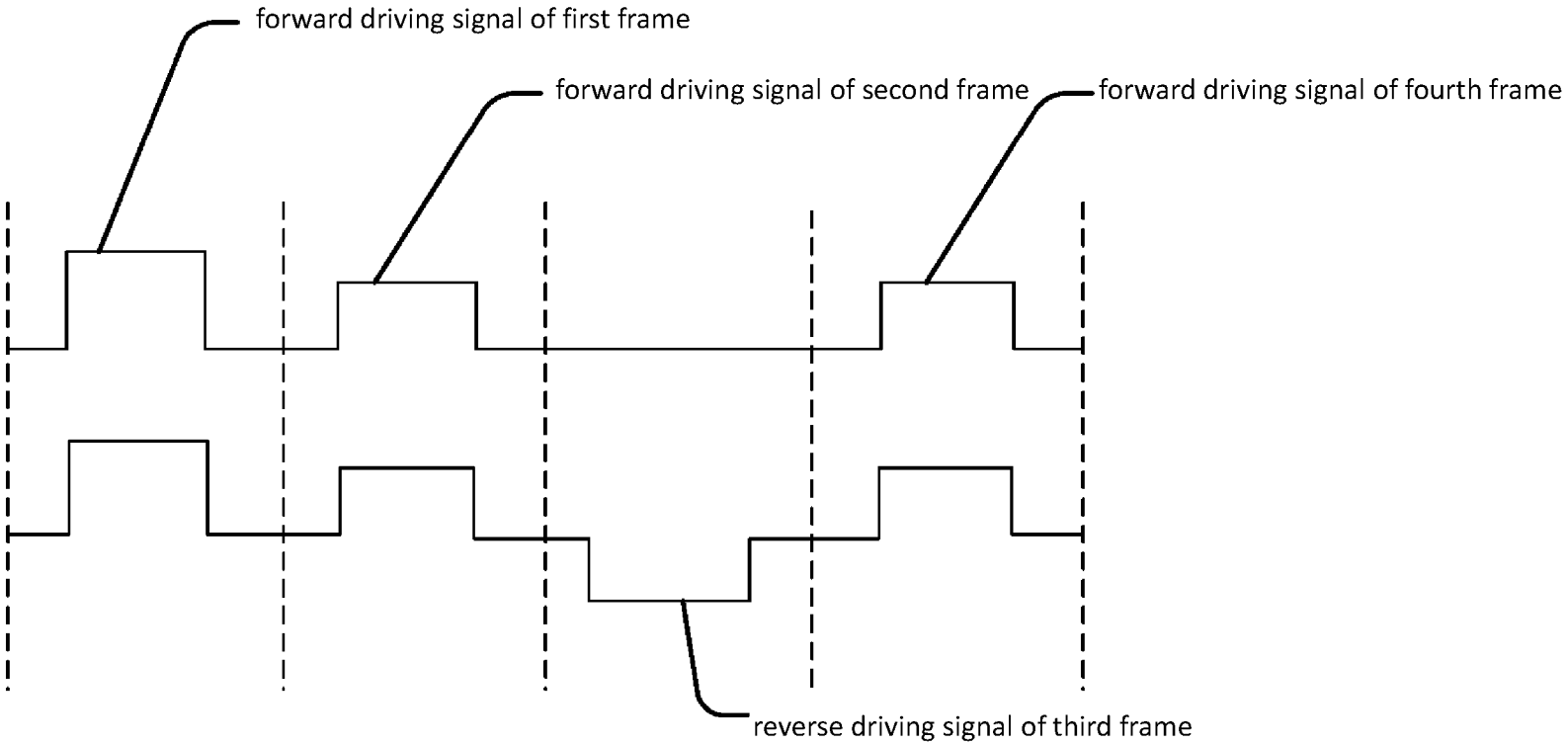
FIG. 3 is a second comparative diagram of with versus without a reverse driving signal being applied according to the present disclosure.

Further, as shown in FIG. 3, in the third frame image, although there is no forward driving signal, a reverse driving signal can still be applied to the third frame image, thereby suppressing the accumulation of electric charges in advance.

Further, in the present disclosure, the reverse driving signal is one of: a reverse voltage, a reverse current, or an alternation of the reverse voltage and the reverse current.

Specifically, when the forward driving signal drives a pre-played video display content, applying a reverse voltage, a reverse current, or an alternation of the reverse voltage and the reverse current, to the video display panel.

When the applied reverse driving signal is a reverse voltage, pixels on the video display panel are in a certain reverse electric field. In the reverse electric field, the electric charges accumulated near the interface can be driven to outside the device by the reverse electric field. In addition, by adjusting an intensity of the reverse electric field, a barrier of the defect potential well may be changed, so that electric charges confined in the potential well can escape, thereby reducing the density of confined electric charges.

The adjustment of the strength of the reverse electric field can be performed by adjusting a time for the reverse voltage, a frequency of the reverse voltage, and an amplitude of the reverse voltage.

Specifically, a percentage of a time for the applied reverse voltage in a cycle, r, is 1%-99%; and the time for the reverse voltage, the application time, can affect brightness and driving mode of the video display. Preferably, the percentage of the time for the reverse voltage in a cycle, r, can be set to 10% to 60%, and the selection of this range does not affect the brightness and the driving mode, and can effectively provide the required voltage for recovery.

Specifically, for the frequency of the reverse voltage, the frequency of the applied reverse voltage should be not less than 60 Hz; preferably, the frequency of the reverse voltage can be set to 60 to 240 Hz because when the frequency of the reverse voltage is higher 240 Hz, the complexity of the circuit can be increased, the cost can be increased, and the required direction driving load can be too large.

Specifically, for the amplitude of the reverse voltage, the amplitude of the applied reverse voltage is −0.1 V to −10 V. Preferably, the amplitude of the reverse voltage can be set to −1 V to −5 V, and the voltage in this amplitude range can be provided by existing circuit board; no need to replace the circuit board. Meanwhile, the voltage amplitude cannot be too low, the elimination effect of the electric charges can be affected when the voltage is lower than −1V. The reverse driving voltage should be less than the breakdown voltage of the video display panel.

When the applied reverse drive signal is a reverse current, the reverse current injects certain electrons and holes into pixels on the video display panel, thereby neutralizing the counter-type carriers confined in the pixels, thereby reducing the density of the confined electric charges.

Specifically, for the time for the applied reverse current, the percentage of the time for the reverse current in a cycle is controlled to be 1% to 99%; preferably, the percentage of the time for the reverse current in a cycle, r, can be set to 10% to 60%, the selection of this range does not affect the brightness and the driving mode, and can provide the required current for recovery.

Specifically, for the frequency of the reverse current, the frequency of the reverse current is controlled to be not less than 60 Hz; preferably, the frequency of the reverse current is set to 60 to 240 Hz. When the frequency of the reverse current is higher than 240 Hz, the complexity of the circuit can be increased, the cost can be increased, and the required direction driving load can be too large.

Specifically, for the amplitude of the reverse current, the amplitude of the applied reverse current is controlled to be −0.0001 Am/cm$^{-2}$ to −1 Am/cm$^{-2}$. Preferably, the amplitude of the reverse current is set to −0.0001 Am/cm$^{-2}$ to −0.1 Am/cm$^{-2}$ because current that is too small results in unapparent electric charge elimination effect. Meanwhile, the reverse current should be lower than the breakdown current of the video display panel to ensure that the device will not be burned out.

Further, in the present disclosure, the waveform of the reverse voltage is one of: a square wave, a triangular wave, a ramp wave or a sine wave; the waveform of the reverse current may also be one of: a square wave, a triangular wave, a ramp wave or a sine wave.

The driving method of the video display panel will be further explained by specific embodiments.

Embodiment One

Figure 4:
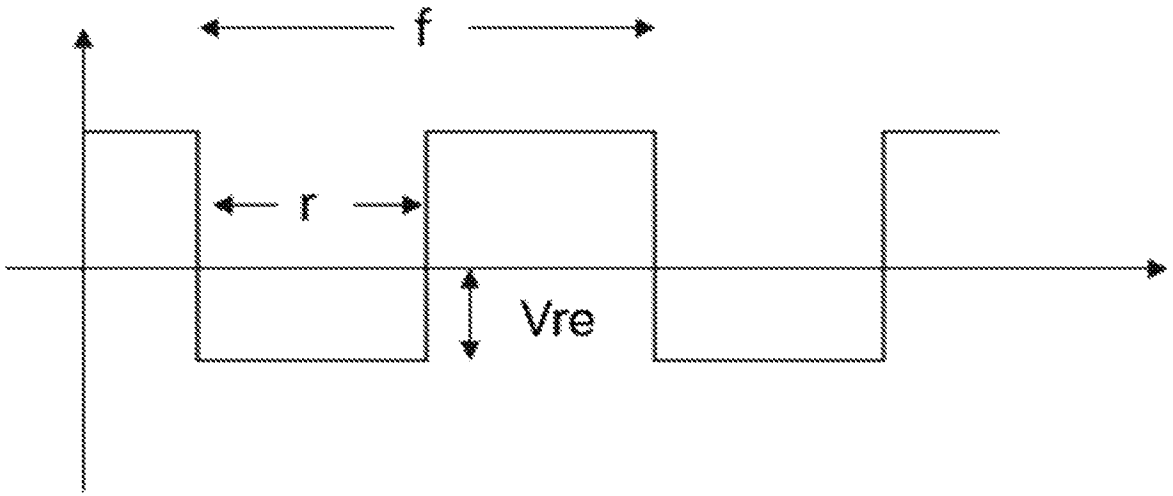
FIG. 4 is of a waveform diagram of a driving signal in Embodiment One of the present disclosure.

When the reverse driving signal is a square wave reverse voltage, as shown in FIG. 4, the reverse voltage follows a forward driving signal closely, and the reverse voltage is lower than a breakdown voltage of the video display panel; the reverse driving signal and the forward driving signal constitute a driving cycle. A percentage of a time for the reverse voltage in a cycle, r, is 1%-99%; a frequency of the reverse voltage, f, is not less than 60 Hz; and an amplitude of the reverse voltage, Vre, is −0.1V to −10V. In specific implementation, suitable percentage, frequency and amplitude within the range can be selected according to the actual situation to achieve an optimal improved effect.

Figure 5:
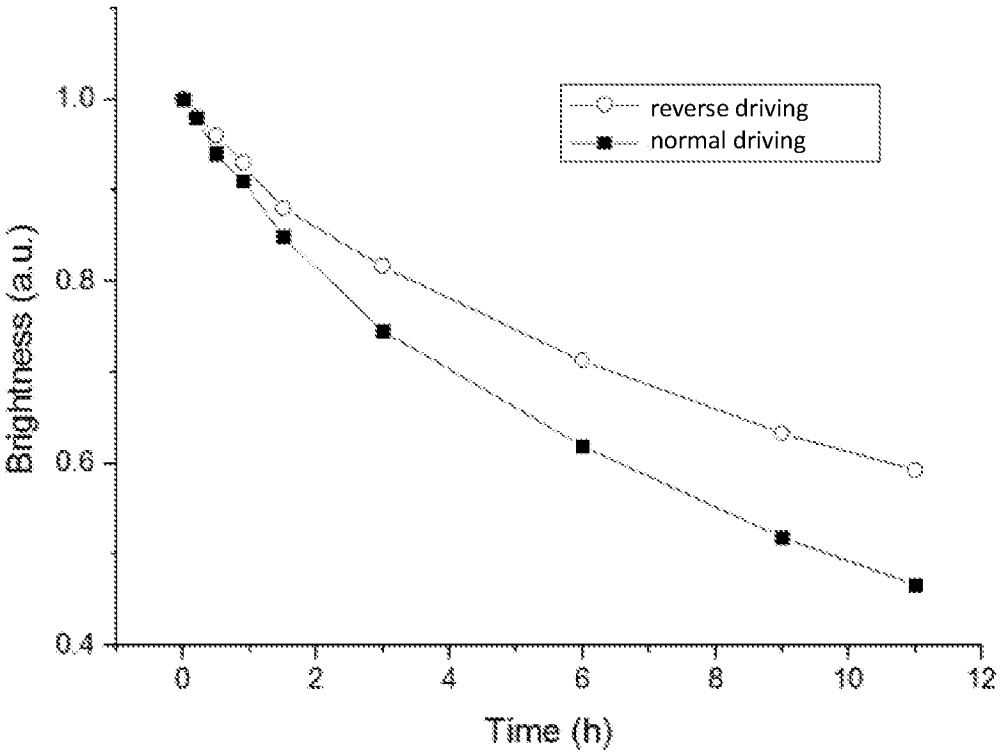
FIG. 5 is a comparison diagram of a lifetime decay curve of a video display panel driven by a reverse driving signal and a lifetime decay curve of a normally driven video display panel in Embodiment One of the present disclosure.

Specifically, when the frequency of the reverse voltage, f, is 60 Hz, the percentage of the time for the reverse voltage in a cycle, r, is 50%, and the amplitude of the reverse voltage, Vre, is −3 V, as shown in FIG. 5, an actual lifetime decay curve of a video display panel driven by a reverse voltage is longer than an lifetime decay curve of the video display panel without a reverse voltage applied, and the degree of attenuation thereof is significantly reduced.

Embodiment Two

Figure 6:
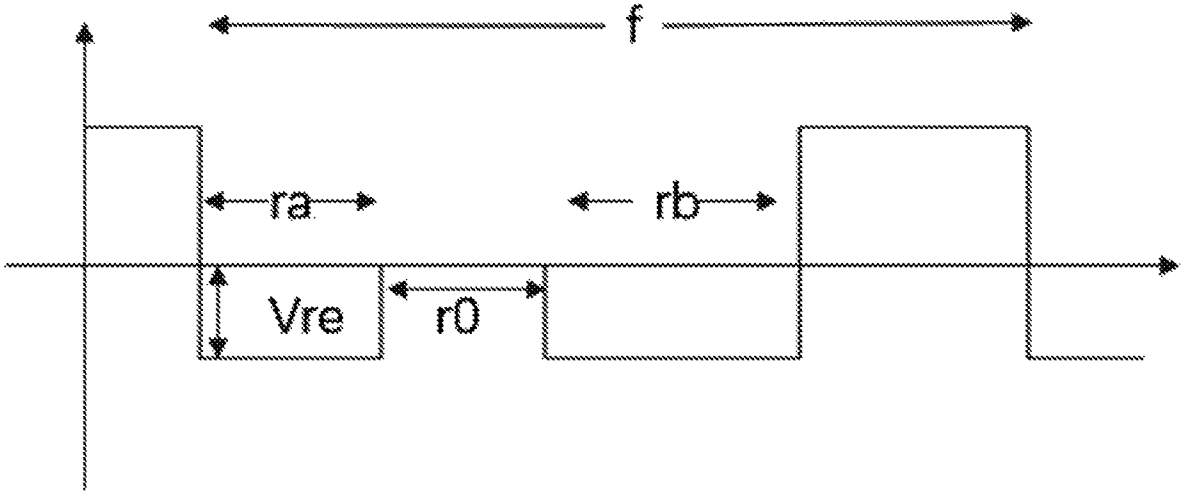
FIG. 6 is a waveform diagram of a driving signal in Embodiment Two of the present disclosure.

When the reverse drive signal is a square wave reverse voltage, as shown in FIG. 6, there is a vacant driving signal in the middle of the reverse driving signal; that is, the reverse voltage follows a forward driving signal closely or follows a vacant driving signal closely; specifically, the reverse driving signal, the forward driving signal, and the vacant driving signal constitute a driving cycle. A percentage of a time for the reverse voltage following the forward drive signal in a cycle is ra; a percentage of a for the reverse voltage following the vacant driving voltage in a cycle is rb; the percentage of a time for the vacant driving signal is r0; and a percentage of a time for the reverse driving signal in a cycle, ra+rb, is 1%-99%; a frequency of the reverse voltage, f, is not less than 60 Hz; and an amplitude of the reverse voltage, Vre, is −0.1 V to −10 V. In specific implementation, suitable percentage, frequency and amplitude within the range can be selected according to actual conditions to achieve optimal improved effect.

Figure 7:
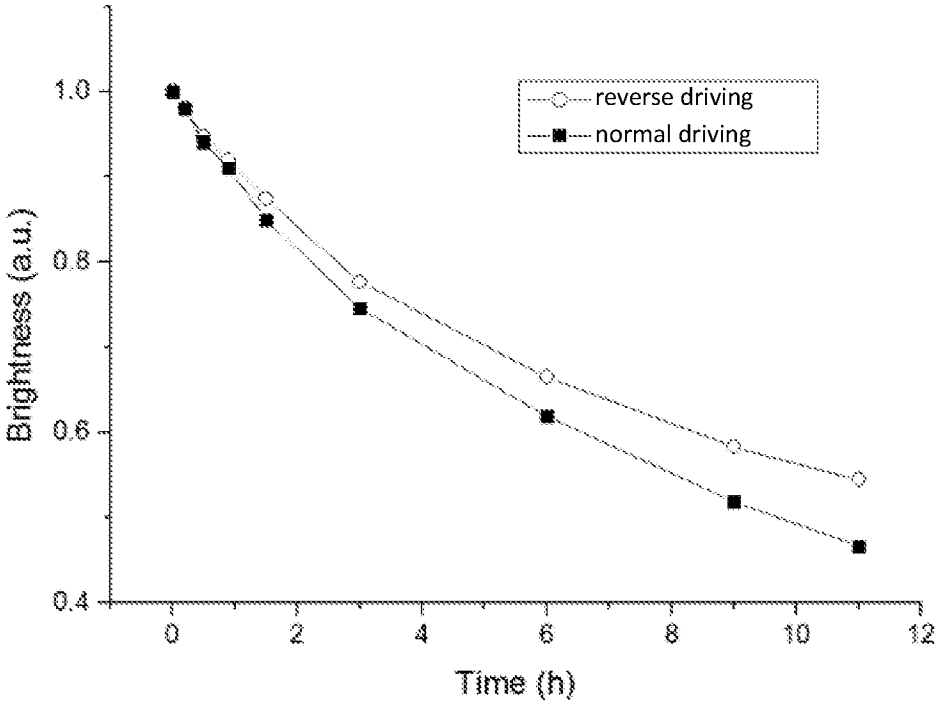
FIG. 7 is a comparison diagram of a lifetime decay curve of a video display panel driven by a reverse driving signal and a lifetime decay curve of a normally driven video display panel in Embodiment Two of the present disclosure.

Specifically, when the frequency of the reverse voltage, f, is 100 Hz, the percentage of the time for the reverse voltage following the forward driving signal in a cycle, ra, is 0%; the percentage of the time for the reverse voltage following the vacant driving signal in a cycle, rb, is 20%; the percentage of the time for the vacant driving signal in a cycle, r0, is 15%; and the amplitude of the reverse voltage, Vre, is −3V. As shown in FIG. 7, an actual lifetime decay curve of a video display panel driven by the reverse voltage is longer than a lifetime decay curve of the video display panel without a reverse voltage applied, and the degree of attenuation thereof is significantly reduced.

Embodiment Three

Figure 8:
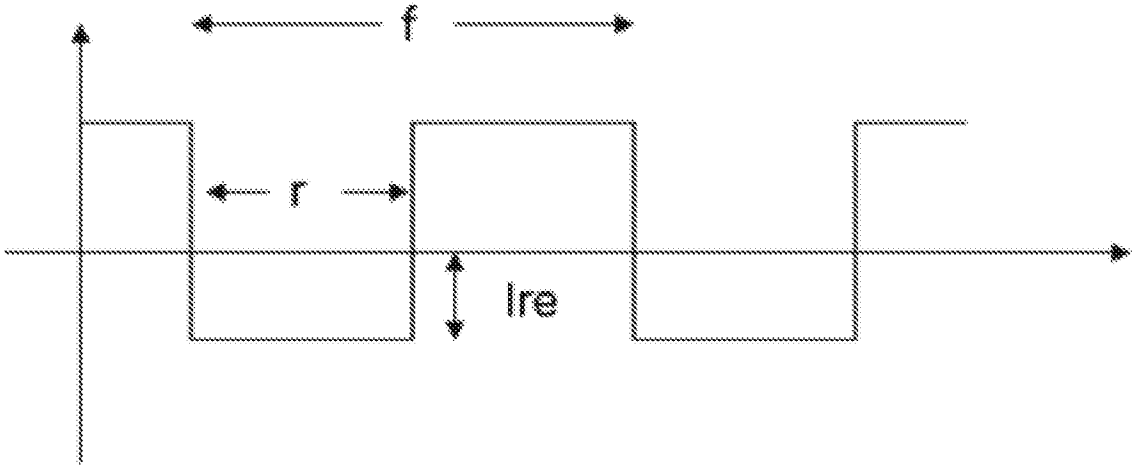
FIG. 8 is a waveform diagram of a driving signal in Embodiment Three of the present disclosure.

When the reverse drive signal is a square wave reverse current, as shown in FIG. 8, the reverse current follows a forward driving signal closely, and the reverse current is less than a breakdown current of the video display panel, the reverse driving signal and the forward driving signal constitute a driving cycle. A percentage of a time for the reverse current in a cycle, r, is 1%-99%; a frequency of the reverse current, f, is not less than 60 Hz; and an amplitude of the reverse current, Ire, is −0.0001 Am/cm-$^{2}$ to −1 Am/cm$^{-2}$. In specific implementation, suitable percentage, frequency and amplitude within the range can be selected according to the actual situation to achieve an optimal improved effect.

Figure 9:
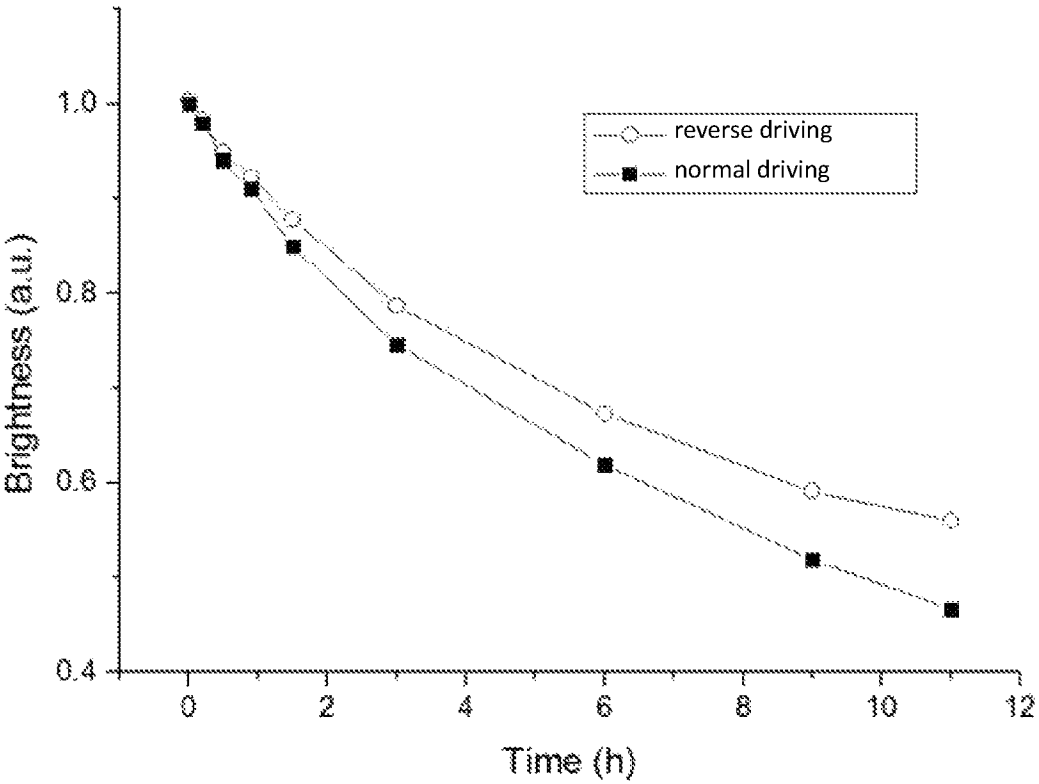
FIG. 9 is a comparison diagram of a lifetime decay curve of a video display panel driven by a reverse driving signal and a lifetime decay curve of a normally driven video display panel in Embodiment Three of the present disclosure.

Specifically, when the frequency of the reverse current, f, is 60 Hz, the percentage of the time for the reverse current in a cycle, r, is 50%, and the amplitude of the reverse current, Ire, is −0.001 Am/cm$^{-2}$, as shown in FIG. 9, an actual lifetime decay curve of a video display panel driven by a reverse current is longer than a lifetime decay curve of the video display panel without a reverse current applied, and the degree of attenuation thereof is significantly reduced.

Embodiment Four

Figure 10:
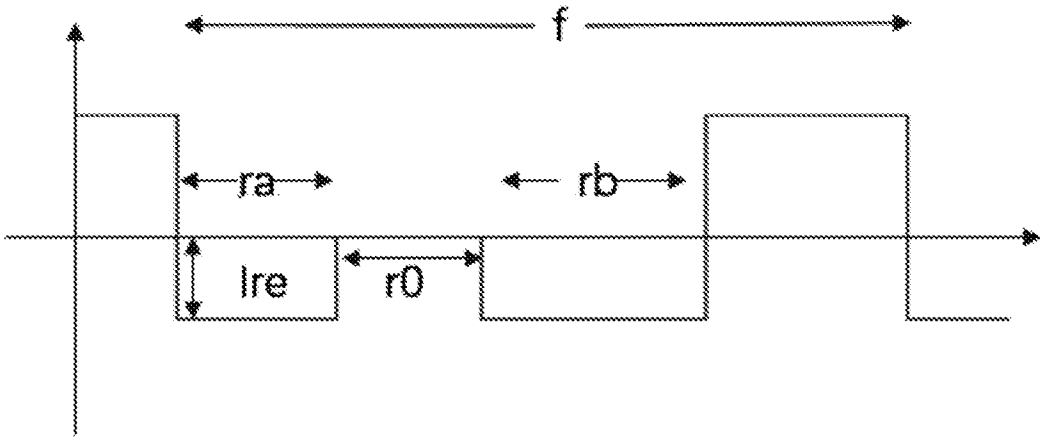
FIG. 10 is a waveform diagram of a driving signal in Embodiment Four of the present disclosure.

When the reverse driving signal is a square wave reverse current, as shown in FIG. 10, there is a vacant driving signal in the middle of the reverse driving signal, and the reverse driving signal may follow a forward driving signal closely or follow a vacant driving signal closely. Specifically, the reverse driving signal, the forward driving signal, and the vacant driving signal constitute a driving cycle. A percentage of a time for the reverse current following the forward driving signal in a cycle is ra; a percentage of a time for the reverse current following the vacant driving signal in a cycle is rb; a percentage of a time for the vacant drive signal in a cycle is r0; and a percentage of a time for the reverse driving signal in a cycle, ra+rb, is 1%-99%. A frequency of the reverse current, f, is not less than 60 Hz, and an amplitude of the reverse current, Ire, is −0.0001 Am/cm$^{-2}$ to −1 Am/cm$^{-2}$. In specific implementation, suitable percentage, frequency and amplitude within the range may be selected according to actual situation to achieve an optimal improved effect.

Figure 11:
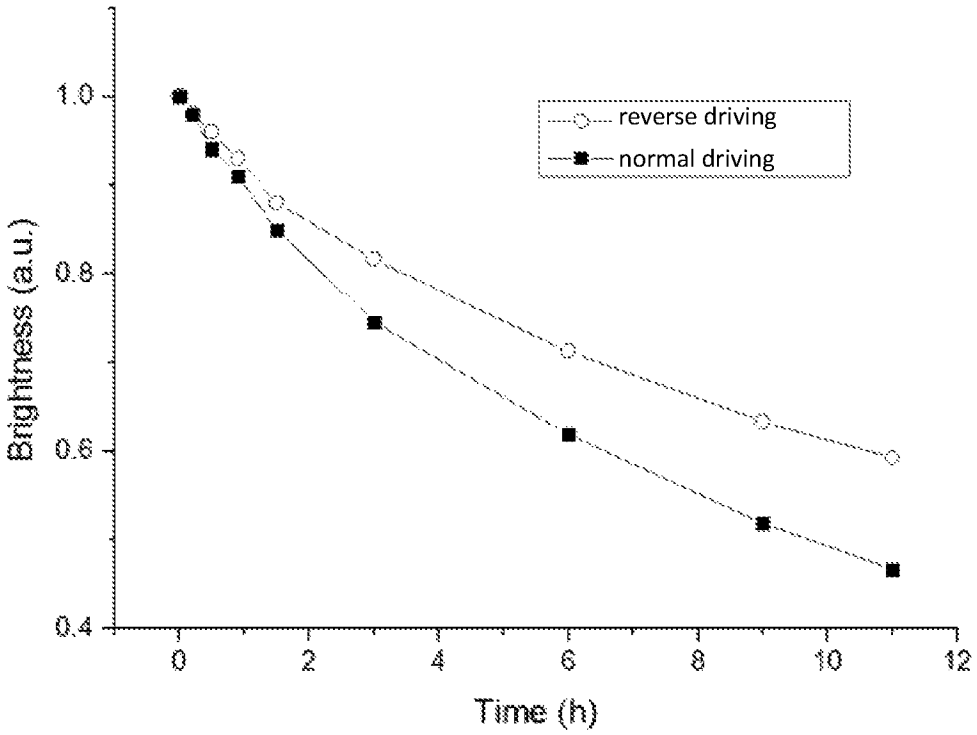
FIG. 11 is a comparison diagram of a lifetime decay curve of a video display panel driven by a reverse driving signal and a lifetime decay curve of a normally driven video display panel in Embodiment Four of the present disclosure.

Specifically, when the frequency of the reverse current, f, is 120 Hz, and the percentage of the time for the reverse current following the forward driving signal in a cycle, ra, is 30%; the percentage of the time for the reverse current following the vacant driving signal in a cycle, rb, is 0%; the percentage of the time for the vacant driving signal in a cycle, r0, is 15%; and the amplitude of the reverse current, Ire, is −0.002 Am/cm$^{-2}$, as shown in FIG. 11, an actual lifetime decay curve of a video display panel driven by the reverse voltage is longer than a lifetime decay curve of the video display panel without a reverse current applied, and the degree of attenuation thereof is significantly reduced.

Embodiment Five

Figure 12:
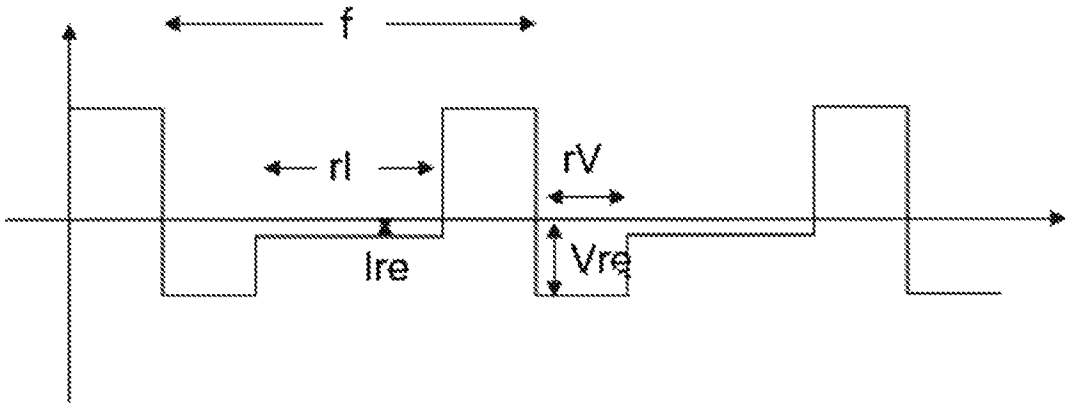
FIG. 12 is a waveform diagram of a driving signal in Embodiment Five of the present disclosure.

When the reverse driving signal is an alternation of a square wave reverse voltage and a square wave reverse current, and the reverse driving signal does not have a vacant driving signal, as shown in FIG. 12, the reverse voltage is lower than a breakdown voltage of the video display panel, the reverse current is less than a breakdown current of the video display panel. A percentage of a time for the reverse voltage in a cycle is rV; a percentage of the time for the reverse current in a cycle is rI; a percentage of a sum of a time for the reverse voltage and a time for the reverse current in a cycle is 1%-99%; a driving frequency, f, is not less than 60 Hz; an amplitude of the reverse voltage, Vre, is −0.1V to −10V; and an amplitude of the reverse current, Ire, is −0.0001 $Am/cm^{-2}$ to −1 $Am/cm^{-2}$.

Figure 13:
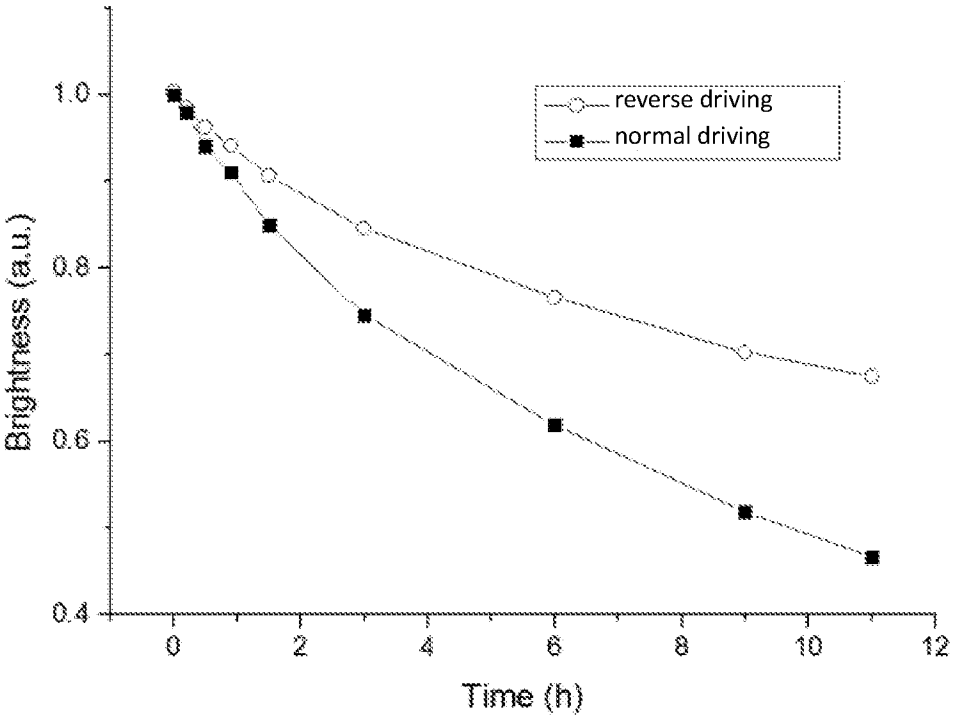
FIG. 13 is a comparison diagram of a lifetime decay curve of a video display panel driven by a reverse drive signal and a lifetime decay curve of a normally driven video display panel in Embodiment Five of the present disclosure.

Specifically, when the driving frequency, f, is 80 Hz, the percentage of the time for the reverse current in a cycle is 50%, the amplitude of the reverse current, Ire, is −0.001 $Am/cm^{-2}$, and the time for the reverse voltage in a cycle, rV, is 40%, and the amplitude of the reverse voltage is −3V. As shown in FIG. 13, an actual lifetime decay curve of a video display panel with reverse driving is longer than a lifetime decay curve of the video display panel without a reverse driving signal applied, and the degree of the attenuation thereof is significantly reduced.

Embodiment Six

Figure 14:
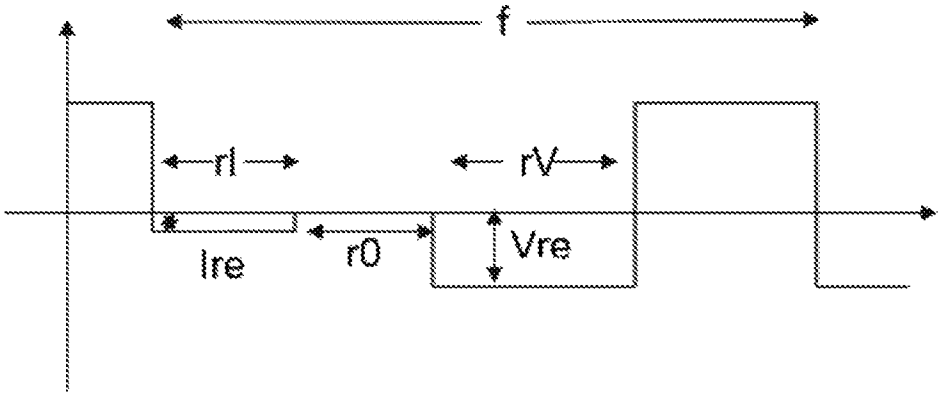
FIG. 14 is a waveform diagram of a driving signal in Embodiment Six of the present disclosure.

When the reverse driving signal is an alternation of a square wave reverse voltage and a square wave reverse current, and there is a vacant driving signal in the reverse driving signal, as shown in FIG. 14, the reverse driving signal, the forward driving signal and the vacant driving signal constitute a driving cycle. A percentage of a time for the reverse voltage in a cycle is rV; a percentage of a time for the reverse current is rI; a percentage of a sum of a time for the reverse voltage and a time for the reverse current in a cycle, rV+rI, is 1%-99%; a percentage of a time for the vacant driving signal in a cycle is r0; an amplitude of the reverse voltage, Vre, is −0.1V to −10V; an amplitude of the reverse current, Ire, is −0.0001 $Am/cm^{-2}$ to −1 $Am/cm^{-2}$. In specific implementation, suitable percentage, frequency and amplitude within the range can be selected according to the actual situation to achieve an optimal improved effect.

Figure 15:
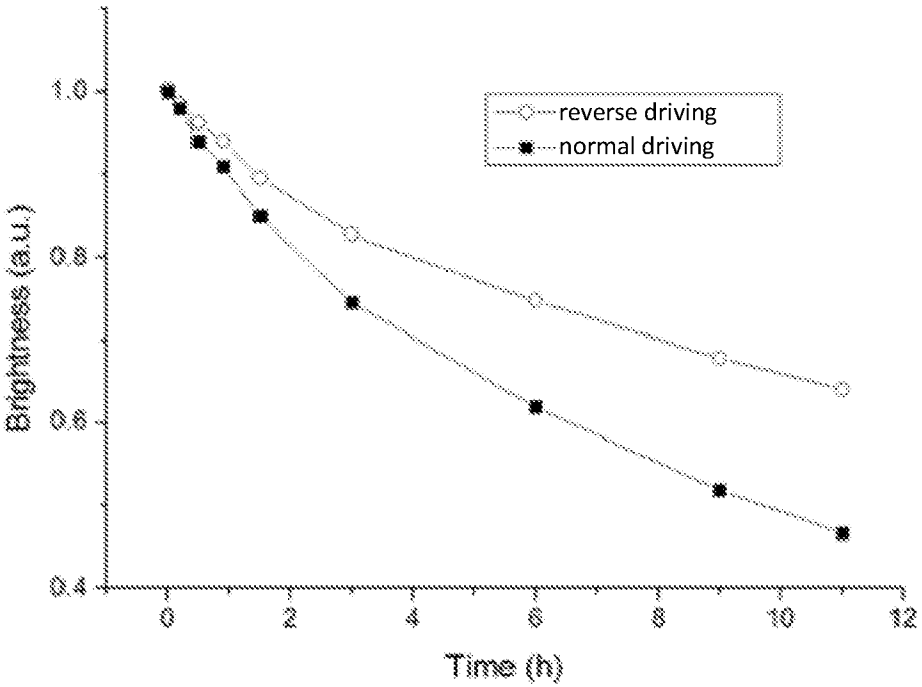
FIG. 15 is a comparison diagram of a lifetime decay curve of a video display panel driven by a reverse driving signal and a lifetime decay curve of a normally driven video display panel in Embodiment Six of the present disclosure.

Specifically, when the frequency of the reverse current, f, is 120 Hz, the percentage of the time for the reverse current following the forward driving signal in a cycle, rI, is 30%; the percentage of the time for the reverse voltage following the vacant driving signal in a cycle, rV, is 10%; the percentage of the time for the vacant driving signal in a cycle, r0, is 15%; the amplitude of the reverse current, Ire, is −0.002 $Am/cm^{-2}$; and the amplitude of the reverse voltage is −2 V, as shown in FIG. 15, an actual lifetime decay curve of a video display panel driven with a reverse voltage is longer than a lifetime decay curve of the video display panel without a reverse driving signal applied, and the degree of attenuation thereof is significantly reduced.

Embodiment Seven

Figure 16:
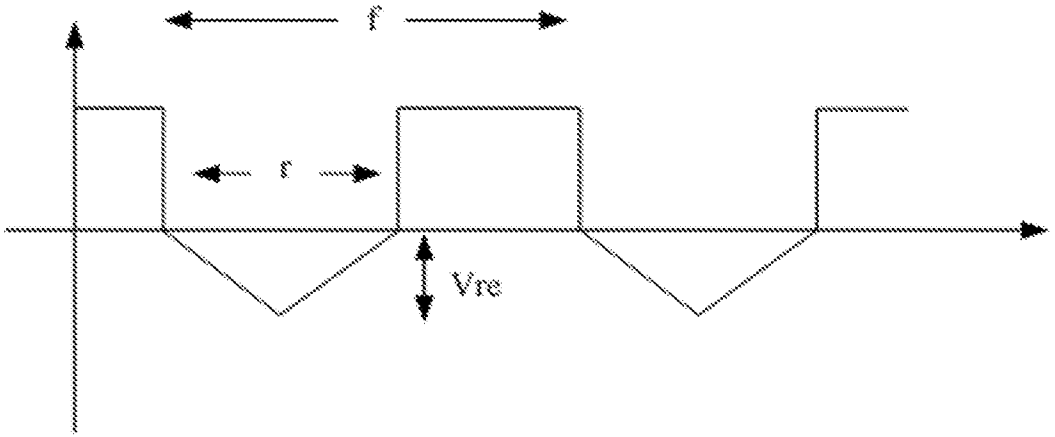
FIG. 16 is a waveform diagram of a driving signal in Embodiment Seven of the present disclosure.

When the reverse driving signal is a triangular wave reverse voltage, as shown in FIG. 16, the triangular wave reverse voltage follows a forward driving signal closely, and the reverse voltage is lower than a breakdown voltage of the video display panel. When the waveform of the reverse voltage is a triangular wave, in the rising phase, the reverse voltage becomes larger as time passes; on the contrary, in the falling phase, the reverse voltage becomes lower as time passes. The dynamic voltage mode effectively reduces the load on the video display panel, enabling a small capacitive and inductive reactance. The reverse driving signal and the forward driving signal constitute a driving cycle. A percentage of a time for the reverse voltage in a cycle, r, is 1%-99%; a frequency of the reverse voltage, f, is not less than 60 Hz; and an amplitude of the reverse voltage, Vre, is −0.1V to −10V. In specific implementation, suitable percentage, frequency and amplitude within the range can be selected according to the actual situation to achieve an optimal improved effect.

Figure 17:
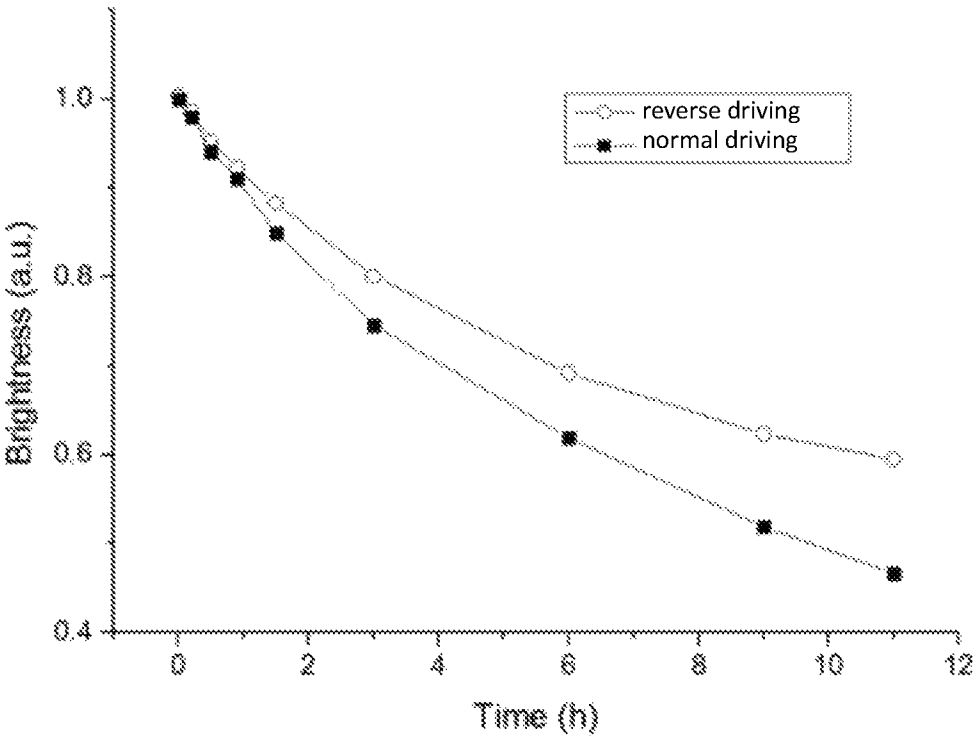
FIG. 17 is a comparison diagram of a lifetime decay curve of a video display panel driven by a reverse driving signal and a lifetime decay curve of a normally driven video display panel in Embodiment Seven of the present disclosure.

Specifically, when the frequency of the reverse voltage, f, is 60 Hz, the percentage of the time for the reverse voltage in a cycle, r, is 50%; the amplitude of the reverse voltage, Vre, is −3 V, as shown in FIG. 17, an actual lifetime decay curve of a video display panel driven by a triangular reverse voltage is longer than a lifetime decay curve of the video display panel without the reverse voltage applied, and the degree of attenuation thereof is significantly reduced.

Embodiment Eight

Figure 18:
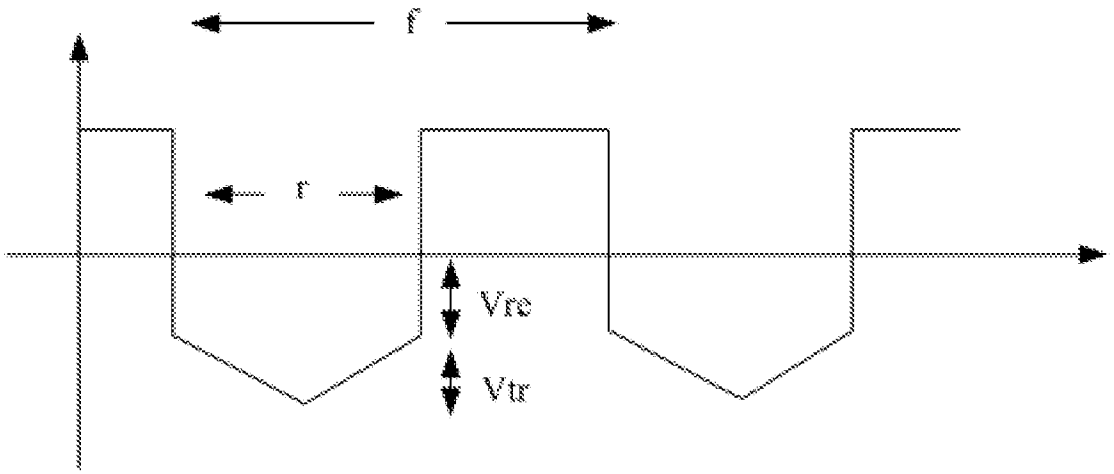
FIG. 18 is a waveform diagram of a driving signal in Embodiment Eight of the present disclosure.

When the reverse driving signal is a triangular wave reverse voltage, and the triangular wave reverse voltage is applied to a negative voltage, Vre, as shown in FIG. 18, a peak value of the triangular wave is Vtr; a percentage of a time for the reverse voltage in a cycle, r, is 1%-99%; a frequency of the reverse voltage, f, is not less than 60 Hz; and an amplitude of the reverse voltage Vre+Vtr, is −0.1V to −10V. In specific implementation, suitable percentage, frequency and amplitude within the range can be selected according to actual situation to achieve an optimal improved effect.

Figure 19:
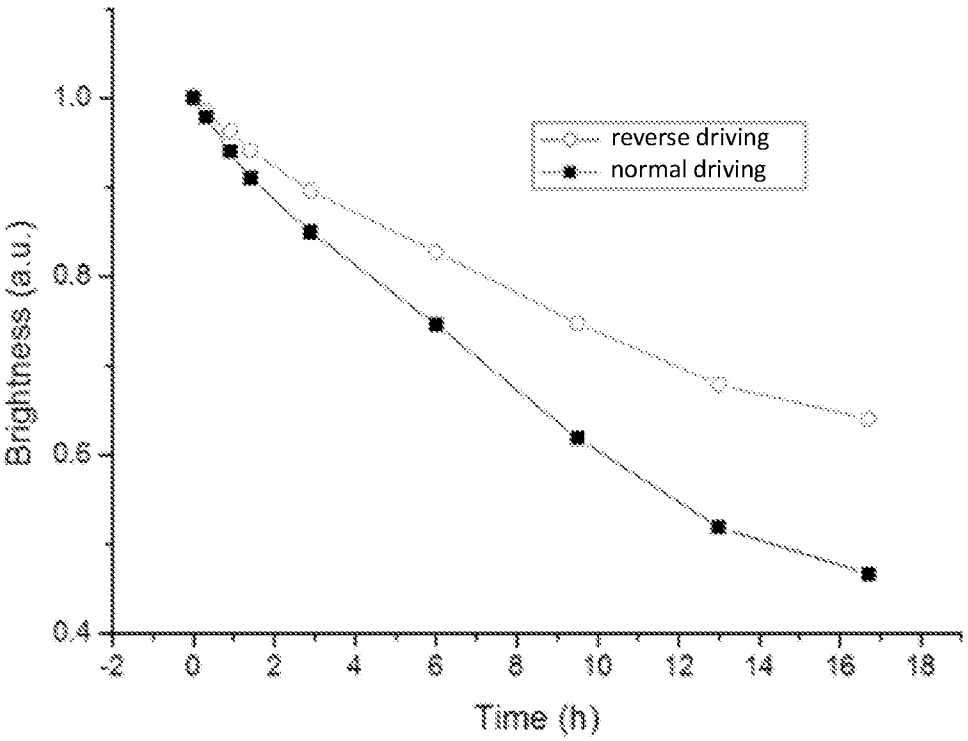
FIG. 19 is a comparison diagram of a lifetime decay curve of a video display panel driven by a reverse drive signal and a lifetime decay curve of a normally driven video display panel in Embodiment Eight of the present disclosure.

Specifically, when the frequency f of the reverse voltage is 60 Hz, the percentage of the time for the reverse voltage in a cycle is 50%, and the amplitude of the reverse voltage Vre+Vtr is −5 V, as shown in FIG. 19, an actual lifetime decay curve of a video display panel driven by a triangular reverse voltage is longer than a lifetime decay curve of the video display panel without the reverse voltage applied, and the degree of attenuation thereof is significantly reduced.

Embodiment Nine

Figure 20:
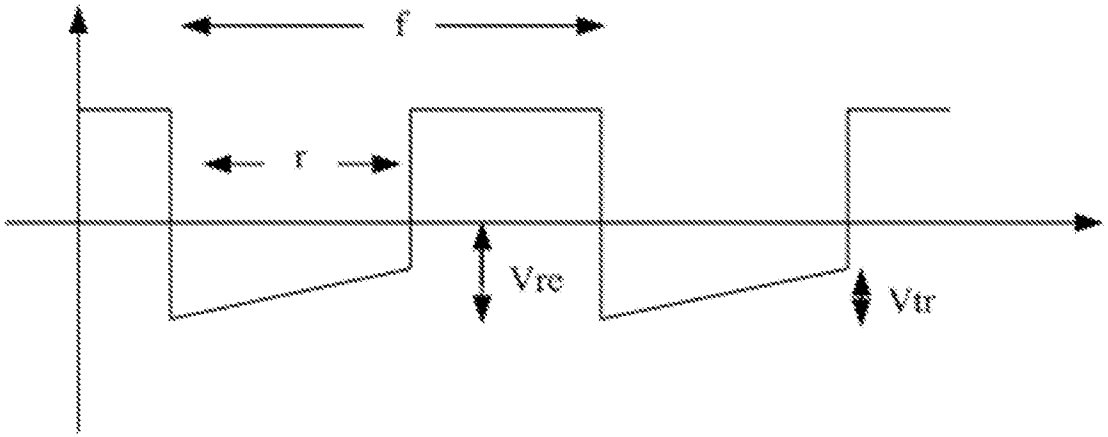
FIG. 20 is a waveform diagram of a driving signal in Embodiment Nine of the present disclosure.

When the reverse driving signal is a ramp reverse voltage and the ramp reverse voltage is applied to a negative voltage, Vre, as shown in FIG. 20, a peak value of the ramp is Vtr, the value of may be positive or negative; a percentage of a time for the reverse voltage, r, is 1%-99%; a frequency of the reverse voltage, f, is not less than 60 Hz; and an amplitude of the reverse voltage, Vr+Vtr, is −0.1V to −10V. In specific implementation, suitable percentage, frequency and amplitude within the range can be selected according to actual situation to achieve an optimal improved effect.

Figure 21:
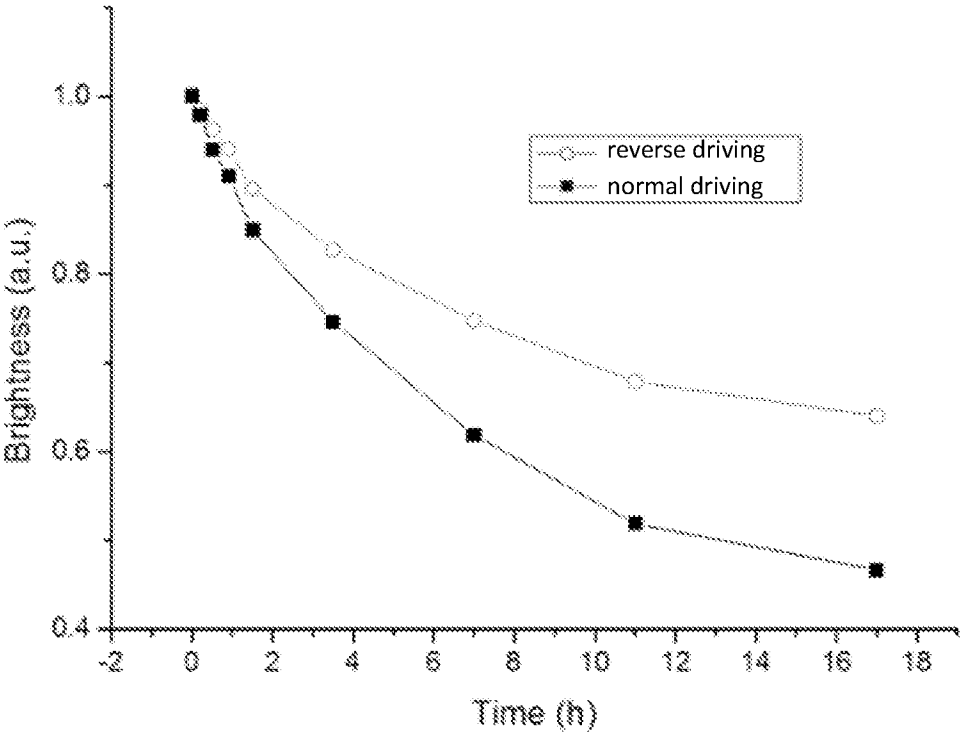
FIG. 21 is a comparison diagram of a lifetime decay curve of a video display panel driven by a reverse driving signal and a lifetime decay curve of a normally driven video display panel in Embodiment Nine of the present disclosure.

Specifically, when the frequency of the reverse voltage, f, is 60 Hz, the percentage of the time for the reverse voltage in a cycle is 50%, and the amplitude of the reverse voltage, Vre+Vtr, is −5 V, as shown in FIG. 21, an actual lifetime decay curve of video display panel driven by the ramp reverse voltage is longer than a lifetime decay curve of the video display panel without the reverse voltage applied, and the degree of attenuation thereof is significantly reduced.

Embodiment Ten

Figure 22:
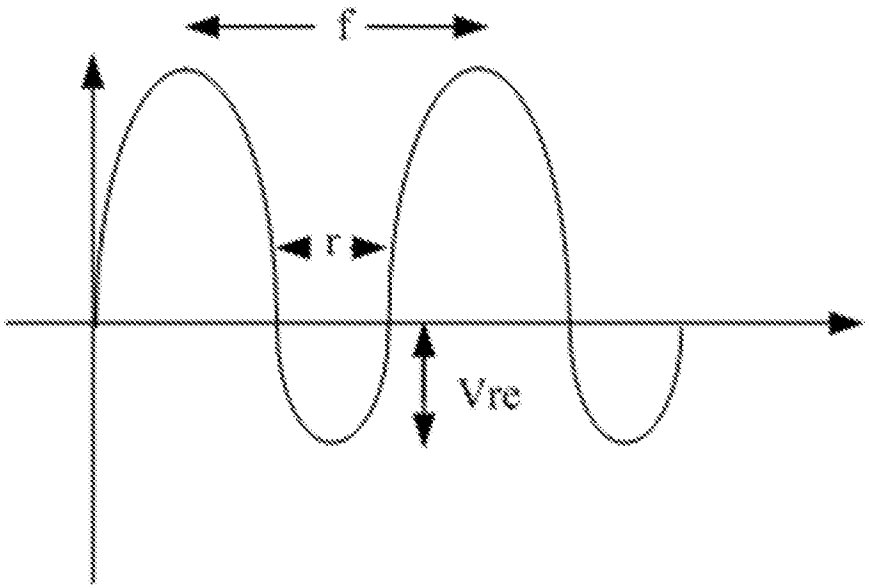
FIG. 22 is a waveform diagram of a driving signal in Embodiment Ten of the present disclosure.

When the direction driving signal is a sine wave reverse voltage, as shown in FIG. 22, the sine wave reverse voltage follows a forward driving signal closely, and the reverse voltage is lower than a breakdown voltage of the video display panel. The sine wave reverse driving signal and the forward driving signal constitute a driving cycle; a percentage of the time for the sine wave reverse voltage in a cycle, r, is 1%-99%; a frequency of the reverse voltage, f, is not less than 60 Hz; an amplitude of the reverse voltage, Vre, is −0.1V to −10V. In specific implementation, suitable percentage, frequency and amplitude within the range can be selected according to actual situation to achieve an optimal improved effect.

Figure 23:
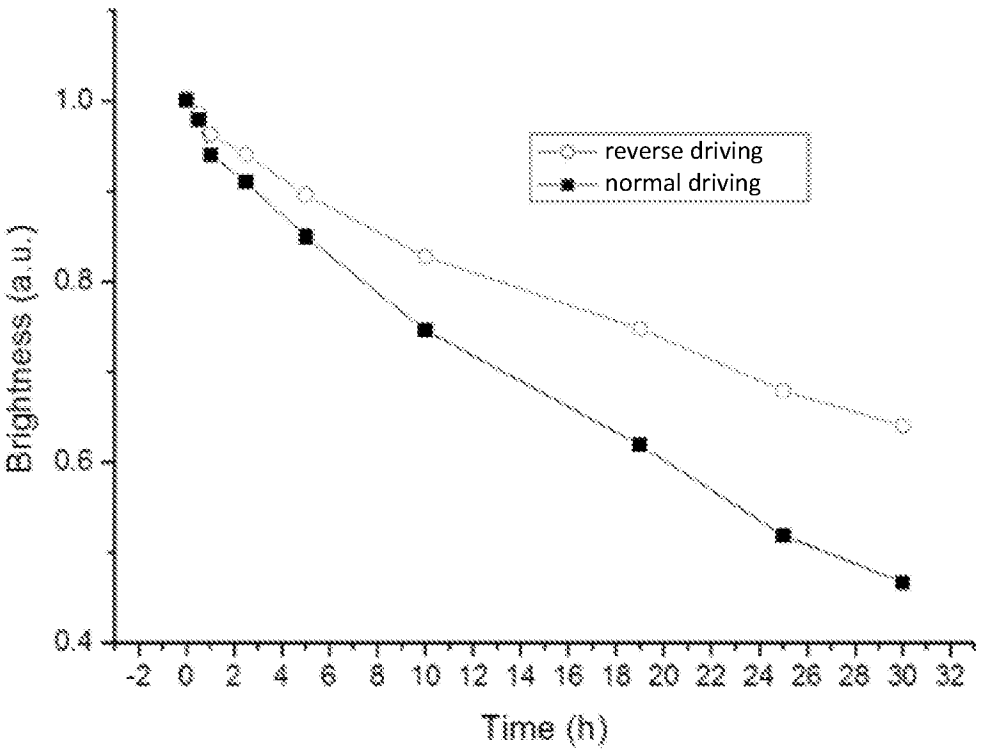
FIG. 23 is a comparison diagram of a lifetime decay curve of a video display panel driven by a reverse driving signal and a lifetime decay curve of a normally driven video display panel in Embodiment Ten of the present disclosure.

Specifically, when the frequency of the reverse voltage, f, is 60 Hz, the percentage of the time for the sine wave reverse voltage, r, is 50%, and the amplitude of the reverse voltage, Vre, is −3 V, as shown in FIG. 23, an actual lifetime decay curve of a video display panel driven by a reverse voltage is longer than the lifetime decay curve of the video display panel without the reverse voltage applied, and the degree of attenuation thereof is significantly reduced.

In summary, the present disclosure provides a preconfigured reverse driving method applied in a video displaying process, pre-acquiring display contents of a plurality of later frames for pixels which are already lit in a video by content loading; adding a reverse driving signal before each forward driving signals for driving the display content of the plurality of frames, to suppress accumulation of electric charges on pixels in a video display panel in advance; the reverse driving signal changes the barrier of the defect potential well, eliminating the electric charges confined and accumulated in the potential well, reducing the density of the confined electric charges, thereby increasing the brightness of the video display and extending the lifetime of the video display panel.

It is to be understood that the application of the present disclosure is not limited to the above-described examples, and those skilled in the art can make modifications and variations in accordance with the above description, all of which are within the scope of the appended claims.

What is claimed is:

1. A reverse driving method for a video displaying process, comprising:

pre-acquiring display content of a plurality of later frames for one or more pixels in a video by content loading; and adding a reverse driving signal to each forward driving signal for driving the one or more pixels, to suppress accumulation of electric charges on the one or more pixels in a video display panel in advance;

wherein the reverse driving signal is a reverse voltage signal, the reverse voltage signal lower being lower than a breakdown voltage of the video display panel.

2. The reverse driving method for a video displaying process according to claim 1, wherein an intensity of the reverse driving signal is proportional to an intensity of the forward driving signal.

3. The reverse driving method for a video displaying process according to claim 1, wherein a waveform of the reverse driving signal includes one or more of: a square wave, a triangular wave, a ramp wave, and a sine wave.

4. The reverse driving method for a video displaying process according to claim 1, wherein the reverse driving signal and the forward driving signal constitute a driving cycle, a time duration for the reverse voltage signal is 1% to 99% of the driving cycle, a frequency of the reverse voltage signal is not less than 60 Hz, and an amplitude of the reverse voltage signal is −0.1V to −10V.

5. The reverse driving method for a video displaying process according to claim 1, wherein the reverse driving signal and the forward driving signal constitute a driving cycle, a time duration for the reverse voltage signal is 10% to 60% of the driving cycle, a frequency of the reverse voltage signal is 60 Hz to 240 Hz, and an amplitude of the reverse voltage signal is −1V to −5V.

6. The reverse driving method for a video displaying process according to claim 1, wherein a vacant driving signal is in the reverse driving signal.

7. The reverse driving method for a video displaying process according to claim 6, wherein the reverse driving signal, the forward driving signal and the vacant driving signal constitute a driving cycle, and a time duration for the vacant driving signal is 0% to 15% of the driving cycle.

8. The reverse driving method for a video displaying process according to claim 1, wherein a vacant driving signal is in the reverse driving signal, the reverse driving signal, forward driving signal and vacant driving signal constitute a driving cycle, a time duration for the reverse voltage signal is 1% to 99% of the driving cycle, a frequency of the reverse voltage signal is not less than 60 Hz, and an amplitude of the reverse voltage signal is −0.1V to −10V.

9. The reverse driving method for a video displaying process according to claim 1, wherein a vacant driving signal is in the reverse driving signal, the reverse driving signal, the forward driving signal and the vacant driving signal constitute a driving cycle, a time duration for the reverse voltage signal is 10% to 60% of the driving cycle, a frequency of the reverse voltage signal is 60 Hz to 240 Hz, and an amplitude of the reverse voltage signal is −1V to −5V.

10. A reverse driving method for a video displaying, comprising:

pre-acquiring display content of a plurality of later frames for one or more pixels in a video by content loading; and adding a reverse driving signal to each forward driving signal for driving the one or more pixels, to suppress accumulation of electric charges on the one or more pixels in a video display panel in advance;

wherein the reverse driving signal is an alternation of a reverse voltage signal and a reverse current signal.

11. The reverse driving method for a video displaying process according to claim 10, wherein the reverse driving signal and the forward driving signal constitute a driving cycle, and a sum of a time duration for the reverse voltage signal and a time duration for the reverse current signal is 1% to 99% of the driving cycle.

12. The reverse driving method for a video displaying process according to claim 11, wherein the sum of the time duration for the reverse voltage signal and the time duration for the reverse current signal is 10% to 60% of the driving cycle.

13. The reverse driving method for a video displaying process according to claim 10, wherein a vacant driving signal is in the reverse driving signal, the reverse drive signal, the forward drive signal and the vacant drive signal constitute a drive cycle, a sum of a time duration for the reverse voltage signal and a time duration for the reverse current signal is 1% to 99% of the driving cycle.

14. The reverse driving method for a video displaying process according to claim 10, wherein a vacant driving signal is in the reverse driving signal, the reverse driving signal, the forward driving signal and the vacant driving signal constitute a driving cycle, a sum of a time duration for the reverse voltage signal and a time duration for the reverse current signal is 10% to 60% of the driving cycle.

15. A reverse driving method for a video displaying process, comprising:

pre-acquiring display content of a plurality of later frames for one or more pixels in a video by content loading; and adding a reverse driving signal to each forward driving signal for driving the one or more pixels, to suppress accumulation of electric charges on the one or more pixels in a video display panel in advance;

wherein the reverse driving signal is a reverse current signal, the reverse current signal being lower than a breakdown current of the video display panel.

16. The reverse driving method for a video displaying process according to claim 15, wherein the reverse driving signal and the forward driving signal constitute a driving cycle, a time duration for the reverse current is 1% to 99% of the driving cycle, a frequency of the reverse current signal is not less than 60 Hz, and an amplitude of the reverse current signal is $-0.0001$ Am/cm$^{-2}$ to $-1$ Am/cm$^{-2}$.

17. The reverse driving method for a video displaying process according to claim 15, wherein the reverse driving signal and the forward driving signal constitute a driving cycle, a time duration for the reverse current signal is 10% to 60% of the driving cycle, a frequency of the reverse current signal is 60 Hz to 240 Hz, and an amplitude of the reverse current signal is $-0.0001$ Am/cm$^{-2}$ to $-0.1$ Am/cm$^{-2}$.

18. The reverse driving method for a video displaying process according to claim 15, wherein a vacant driving signal is in the reverse driving signal, the reverse driving signal, forward driving signal and vacant driving signal constitute a driving cycle, a time duration for the reverse current signal is 1% to 99% of the driving cycle, a frequency of the reverse current signal is not less than 60 Hz, and an amplitude of the reverse current signal is $-0.0001$ Am/cm$^{-2}$ to $-1$ Am/cm$^{-2}$.

19. The reverse driving method for a video displaying process according to claim 15, wherein a vacant driving signal is in the reverse driving signal, the reverse driving signal, the forward driving signal and the vacant driving signal constitute a driving cycle, a time duration for the reverse current signal is 10% to 60% of the driving cycle, a frequency of the reverse current signal is 60 Hz to 240 Hz, and an amplitude of the reverse current signal is $-0.0001$ Am/cm$^{-2}$ to $-0.1$ Am/cm$^{-2}$.

* * * * *